US008516630B2

(12) United States Patent
Gugliotti et al.

(10) Patent No.: US 8,516,630 B2
(45) Date of Patent: Aug. 27, 2013

(54) CONVERTIBLE WHEELCHAIR

(75) Inventors: John Joseph Gugliotti, Malden, MA (US); Robert Edward Parkin, Dunstable, MA (US)

(73) Assignee: University of Massachusetts, Boston, MA (US)

( * ) Notice: Subject to any disclaimer, the term of this patent is extended or adjusted under 35 U.S.C. 154(b) by 0 days.

(21) Appl. No.: 12/963,113

(22) Filed: Dec. 8, 2010

(65) Prior Publication Data

US 2012/0144582 A1 Jun. 14, 2012

(51) Int. Cl.
*A61G 7/10* (2006.01)

(52) U.S. Cl.
USPC ..... 5/86.1; 5/613

(58) Field of Classification Search
USPC ..... 5/613, 86.1
See application file for complete search history.

(56) References Cited

U.S. PATENT DOCUMENTS 2,849,051 A * 8/1958 Streeter Ill ..... 297/344.16
3,379,450 A * 4/1968 Jones et al. ..... 280/657
4,387,325 A 6/1983 Klimo
4,632,450 A 12/1986 Holdt
4,949,408 A 8/1990 Trkla
4,997,200 A 3/1991 Earls
5,179,745 A 1/1993 Hebert et al.
5,333,887 A 8/1994 Luther
5,380,034 A 1/1995 Wilson
5,402,544 A 4/1995 Crawford et al.
RE35,201 E * 4/1996 Krauska ..... 5/618
5,584,082 A * 12/1996 Crawford et al. ..... 5/86.1
5,896,602 A * 4/1999 Marblestone ..... 5/81.1 R
6,131,215 A * 10/2000 Lindell ..... 5/86.1
6,173,461 B1 * 1/2001 Alexander ..... 5/618
6,206,393 B1 3/2001 Mascari et al.
6,272,702 B1 * 8/2001 Uchida et al. ..... 5/600
6,351,678 B1 * 2/2002 Borders ..... 700/83
D454,319 S 3/2002 Ito
6,351,861 B1 * 3/2002 Shows et al. ..... 5/618
6,499,163 B1 * 12/2002 Stensby ..... 5/618
6,516,480 B2 * 2/2003 Elliott ..... 5/618
6,701,546 B2 3/2004 Hodgetts
6,792,633 B1 * 9/2004 Ito ..... 5/618
6,799,770 B2 10/2004 Patrick et al.
6,866,288 B2 3/2005 Martin (Continued)

OTHER PUBLICATIONS

Barton Convertible I-Series Owner Operation Manual, OM 003, Rev. 03004, Aug. 9, 2009.

*Primary Examiner* — Robert G Santos
*Assistant Examiner* — David E Sosnowski
(74) *Attorney, Agent, or Firm* — John H. Pearson, Jr., Esq.; Walter F. Dawson, Esq.; Pearson & Pearson, LLP.

(57) ABSTRACT

A convertible wheelchair having two self-propelling rear wheels and two front casters, electric controls for converting from a chair position to a reclined position by an electric actuator connected between a bottom panel of a frame and under a seat support, a backrest connected pivotally at intermediate points between sides of the frame, and a leg support pivotally connected to front corners of the frame and front ends of the seat support. The wheelchair may be secured adjacent to a bed by a mount disc on a center portion of the rear wheels enabling a user to safely convert the wheelchair to the reclined position by moving a switch of the electric controls. When reclined, the user may move over onto the bed without a caregiver's assistance, unless necessary.

18 Claims, 11 Drawing Sheets

(56) References Cited

U.S. PATENT DOCUMENTS

| | | | | |
|---|---|---|---|---|
| 6,886,194 | B2 | 5/2005 | Hodgetts | |
| 7,131,154 | B2 | 11/2006 | Davis et al. | |
| 7,302,717 | B2 * | 12/2007 | Reinke et al. | 5/86.1 |
| 7,406,731 | B2 * | 8/2008 | Menkedick et al. | 5/618 |
| 7,487,562 | B2 * | 2/2009 | Frondorf et al. | 5/613 |
| 7,686,319 | B1 * | 3/2010 | Fink | 280/304.1 |
| 7,926,131 | B2 * | 4/2011 | Menkedick et al. | 5/618 |
| 7,996,939 | B2 * | 8/2011 | Benedict et al. | 5/611 |
| 8,011,035 | B2 * | 9/2011 | Pizzi Spadoni | 5/86.1 |
| 2002/0170110 | A1 * | 11/2002 | Hodgetts | 5/86.1 |
| 2004/0205894 | A1 | 10/2004 | Hodgetts | |
| 2004/0212173 | A1 * | 10/2004 | Wing | 280/304.1 |
| 2006/0185079 | A1 * | 8/2006 | Walkingshaw | 5/86.1 |
| 2006/0218724 | A1 * | 10/2006 | Blevins | 5/81.1 R |
| 2006/0248649 | A1 | 11/2006 | Kuenzel | |
| 2008/0097256 | A1 * | 4/2008 | Torres et al. | 601/24 |
| 2008/0315548 | A1 * | 12/2008 | Ditch | 280/242.1 |
| 2009/0158523 | A1 * | 6/2009 | Burak et al. | 5/87.1 |
| 2009/0199339 | A1 * | 8/2009 | Barr | 5/602 |
| 2010/0276898 | A1 * | 11/2010 | Johnson et al. | 280/6.151 |
| 2012/0047648 | A1 * | 3/2012 | Purwar et al. | 5/86.1 |

* cited by examiner

CONVERTIBLE WHEELCHAIR

BACKGROUND OF THE INVENTION

1. Field of the Invention

The present invention relates generally to convertible wheelchairs, and more particularly, to a wheelchair apparatus that enables a person sitting in the wheelchair to convert the wheelchair to a reclined position or gurney by activating motor controls thereby enabling the person to independently transfer from the wheelchair to a bed.

2. Description of Related Art

The nursing industry is a leading occupation suffering from back injury due to continual bending down and lifting of patients which puts a strain on a person's lower back: this is verified by multiple studies performed over the past years. This statistic leads to the need for a wheelchair that can assist in the reorienting of a patient from a seated position to a fully reclined position level with a bed. The patient can transfer with or without assistance from the reclined position of the wheelchair to the bed and vice versa. The convertible wheelchair alleviates the need for continual bending down to move the patient in and out of bed. More significant is the ability for a patient in a home environment to be able to get in and out of bed without the need of assistance by a nurse or a caretaker.

The convertible wheelchair is not only beneficial for the nurses but for the patients as well. The patient would not have to be subject to awkward liftings by nursing personnel. It would provide patients with some dignity because they would not have to endure any embarrassment associated with having to be lifted to get in and out of bed.

A convertible wheelchair in the long term will allow members of the nursing community to have longer careers due to the decrease of strain placed on their lower backs. Although this device would alleviate the need to bend down and pick up a patient when placing them in a bed or gurney, it does not eliminate all the lifting duties of the nurses, because they will still be required to assist the patients to their feet or transfer patients from wheelchair to regular chair or wheelchair to toilet.

There are a number of inventions in the prior art that combine a wheelchair and a gurney function as follows:

U.S. Pat. No. 4,997,200 issued Mar. 5, 1991 to R. J. Earls discloses a combination wheelchair-gurney apparatus including a pivoting back rest and footrest which permit the wheelchair to be transformed into a gurney and vice versa. An additional wheel assembly is required to provide support for the back rest when the apparatus is in the gurney position. The wheelchair has large rear wheels to enable the user to self-propel the wheelchair. The apparatus requires at least one caregiver to participate in the process of converting the wheelchair to a gurney and to participate in the process of transferring a patient from the gurney to a bed, whereas in the present invention, the design enables many patients, if physically capable, to perform the conversion alone.

U.S. Pat. No. 5,333,887 issued Aug. 2, 1994 to H. M. Luther discloses a combination wheelchair/gurney having a three-part seat/gurney bed assembly, hingedly connected and pivotally mounted on a rigid metal rectangular frame, having two large side wheels for patient self-locomotion and two front caster wheels, and a seat supporter/locking position mechanism which carries most of the seat weight and is pivotally mounted to the frame bottom. The wheelchair converts to a gurney, but requires an attendant to pull back and downward on the top back of the chair in a levered action. The present invention can be converted from a chair to a gurney by a person in the wheelchair using an electric switch on the wheelchair.

U.S. Patent Application Publication No. 2003/0193166, published Oct. 16, 2003, discloses a convertible wheelchair with a lift module for engaging and elevating the convertible wheelchair whereby the wheelchair can be converted to any one of several examination configurations. However, the wheelchair has to be attached to and detached from the lift module which would be a difficult task for a disabled user of the wheelchair compared to the convertible wheelchair of the present invention that does not require such attaching and detaching of another device such as the lift module.

SUMMARY OF THE INVENTION

Accordingly, it is therefore an object of this invention to provide a low cost wheelchair that converts from a chair to a reclined or gurney position along with intermediate positions under the control of a patient allowing the patient to transfer without assistance, unless necessary, from the wheelchair to a bed.

It is another object of this invention to provide for transfer of a patient from a wheelchair to a bed without a nurse or caretaker having to bend down and lift the patient into a bed.

It is a further object of this invention to provide a low cost, self-propelled, large rear wheel wheelchair that a patient can convert to a reclined position by electric controls after being engaged to a side of a bed.

It is yet another object of this invention to provide a convertible wheelchair that has simplified construction for economical manufacture.

These and other objects are further accomplished by a convertible wheelchair comprising means for forming a chair within a frame having components pivotally interconnected, means attached between a bottom portion of the frame and a seat portion of the chair for converting the wheelchair from a chair position to a reclined position or from a reclined position to the chair position, and means attached to a right side and a left side of the frame for supporting the chair forming means. The chair forming means comprises a backrest pivotally attached to a first section of a seat and a leg rest pivotally attached to a second section of the seat. The converting means comprises means for controlling converting of the wheelchair from the chair position to a reclined position or from the reclined position to the chair position in response to a signal generated by a user's action. The supporting means comprises a pair of large rear wheels and a pair of smaller wheels attached to the frame. The chair forming means comprises two sets of a four-bar linkage.

The objects are further accomplished by a convertible wheelchair comprising a frame supported by front wheels and rear wheels, a backrest pivotally mounted at intermediate points between first and second sides of the frame, a seat having front and rear ends and connected pivotally on its rearward ends to lower ends of the backrest, a leg rest having upper ends pivotally connected to front corners of the frame and intermediate points on the leg rest connected to the front ends of the seat, an actuator having a lower end mounted to a bottom panel of the rigid frame and an upper end attached at a predetermined angle to approximately a midsection of the seat, and controls including a switch for a user to activate the actuator which converts the wheelchair from a chair position to a reclined position or from a reclined position to a chair position. The leg rest comprises a pair of footrests which pivot to a horizontal position when the wheelchair converts from the chair position to the reclined position. A bottom panel is positioned between the frame for supporting a power source and electric controls. The wheelchair comprises means positioned adjacent to each of the rear wheels for stopping the wheelchair. The wheelchair comprises a leg rest adjacent to said leg rest extension for closing space between the wheelchair and a transfer area when the wheelchair is in the reclined position. The wheelchair comprises means for preventing the wheelchair from tipping backwards which includes an anti-tip arm with at least two interconnected links. The actuator controls activated by the user comprise a pair of limit switches activated by an actuator arm of the actuator when the activator arm is fully extended, and a second switch of said pair of limit switches being activated when said actuator arm is fully retracted. Each point of connection between the frame, backrest, seat and leg rest of the wheelchair comprises a bearing. The connections between the frame, the backrest, the seat and the leg rest comprise a first pair of four-bar linkages. The leg rest comprises a footrest mechanism having a second pair of four-bar linkages. The rear wheels comprise a docking disc in the center of each wheel, and each of the front wheels comprise a caster.

The objects are further accomplished by a method for making a convertible wheelchair comprising the steps of supporting a frame by attaching front wheels and rear wheels, mounting a backrest at intermediate points between first and second sides of the frame with bearings, connecting rear ends of a seat to lower ends of the backrest with bearings, connecting upper ends of a leg rest to front corners of the frame with bearings and connecting intermediate points on the leg rest to the front ends of the seat with bearings, mounting a lower end of an actuator to a bottom panel of the frame and attaching an upper end at a predetermined angle to approximately a mid-section of the seat, and providing controls including a switch for a user to activate the actuator which converts the wheelchair from a chair position to a reclined position or from a reclined position to a chair position. The method comprises the step of providing a power source for operating the controls within the convertible wheelchair. The method comprises the step of providing a side extension adjacent to the leg rest for closing space between the convertible wheelchair and a bed when the convertible wheelchair is in the reclined position. The method comprises the step of providing means for preventing the wheelchair from tipping backwards. The step of providing a means for preventing the wheelchair from tipping backwards further comprises the step of providing an anti-tip arm having at least two interconnected links. The step of providing controls comprises the step of providing a pair of limit switches for said actuator, a first switch of the pair of limit switches being activated by an actuator arm of the actuator when the actuator arm is fully extended, and a second switch of the pair of limit switches being activated when the actuator arm is fully retracted. The method comprises the step of connecting the frame, the backrest, the seat and the leg rest with a first pair of four-bar linkages. The method comprises the step of connecting a footrest mechanism to the leg rest with a second pair of four-bar linkages. The method comprises the step of providing a docking disc in the center of each of the rear wheels. The method comprises the step of supporting a frame by front wheels and rear wheels and further comprises the step of providing a caster for each of the front wheels.

Additional objects, features and advantages of the invention will become apparent to those skilled in the art upon consideration of the following detailed description taken in connection with the accompanying drawings of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
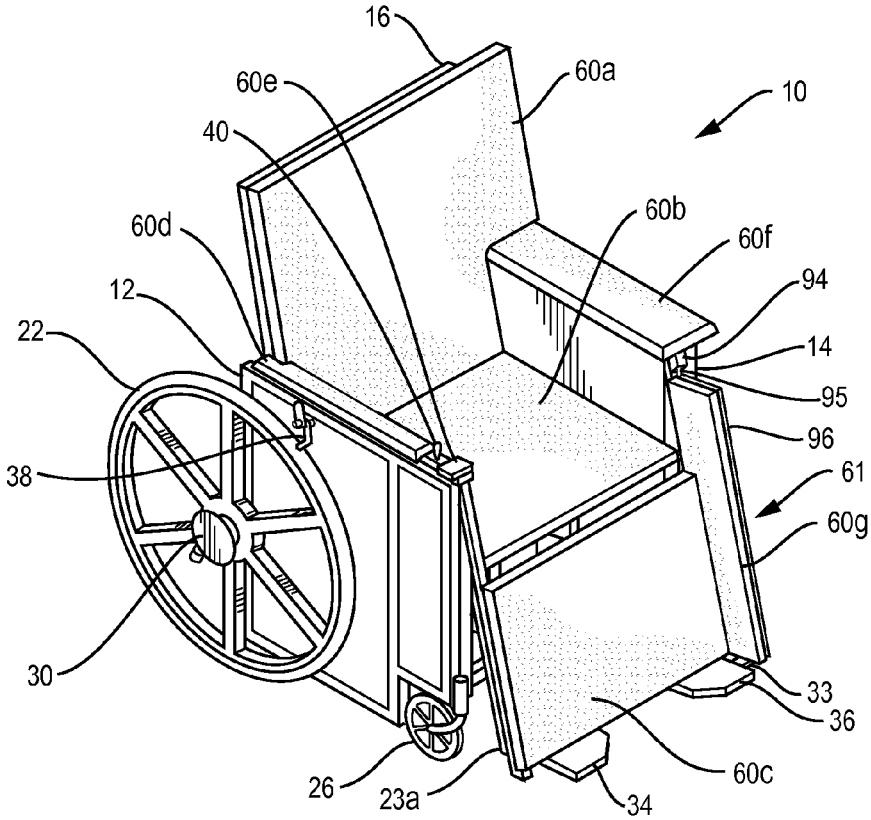
FIG. 1 is a side perspective view of a convertible wheelchair in an upright position according to the present invention.
Figure 2:
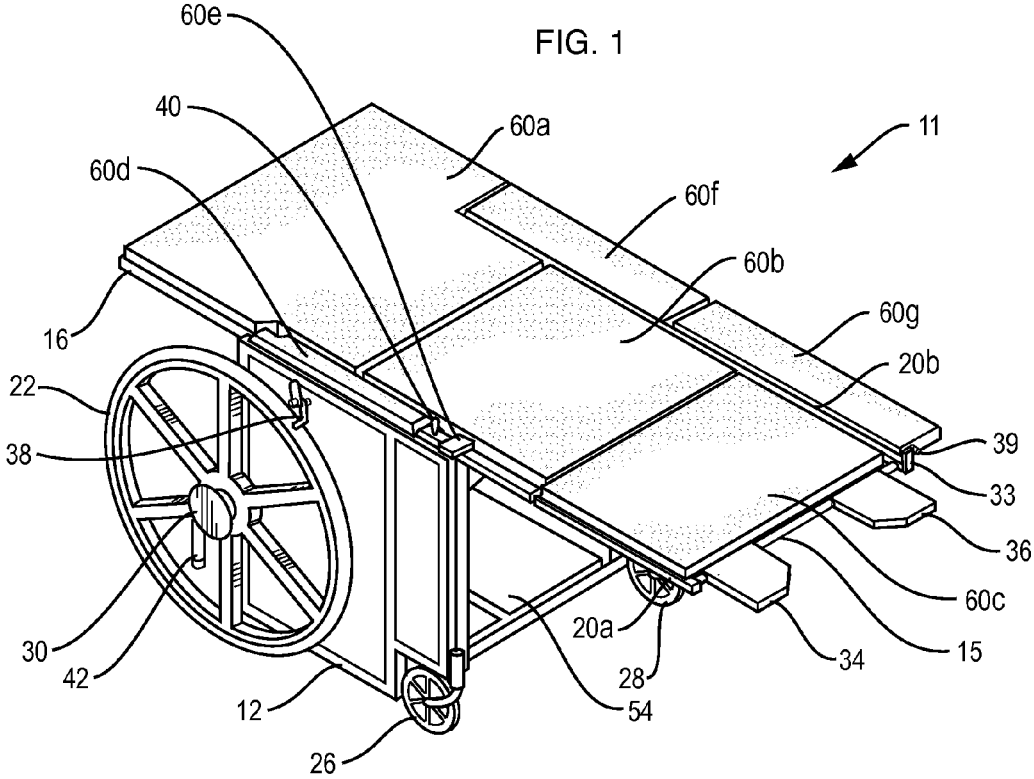
FIG. 2 is a side perspective view of the convertible wheelchair of FIG. 1 in a reclined position according to the invention.

Referring to FIG. 1 and FIG. 2, FIG. 1 shows a right side perspective view of a convertible wheelchair 10 and FIG. 2 shows a right side perspective view of the wheelchair converted to a reclined position 11 (or gurney) according to the present invention. The convertible wheelchair 10 is designed to be low cost and it is particularly useful for enabling a patient to get in and out of bed without the assistance of a nurse or caregiver, and when assistance is required, it helps to avoid back injury to the caregiver when lifting the patient. The convertible wheelchair 10 typically comprises upholstered padding in the areas where the patient contacts the wheelchair 10 when sitting in the wheelchair. These areas are represented by reference numbers 60*a* to 60*g*. References to the left side and right side of the wheelchair 10 are relative to a patient sitting in the chair and facing forward.

Figure 3:
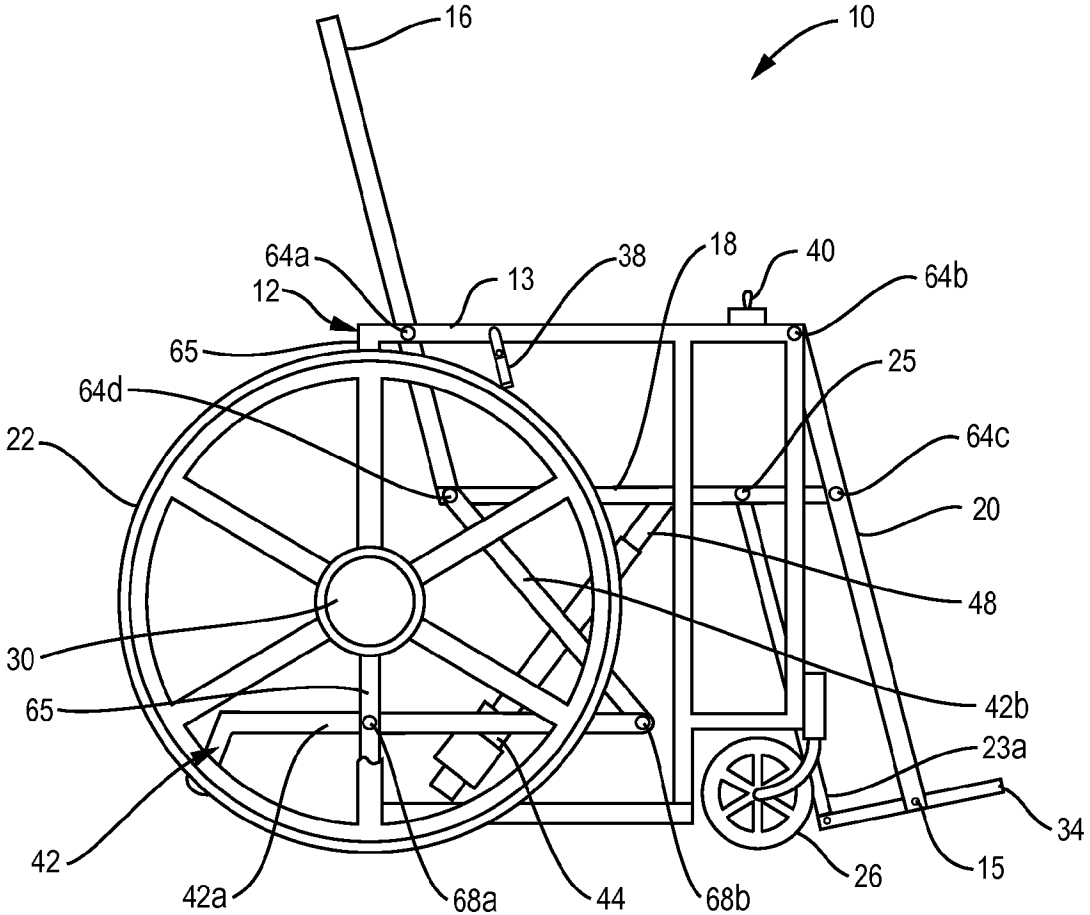
FIG. 3 is a side elevational view of the convertible wheelchair in a chair position.
Figure 4:
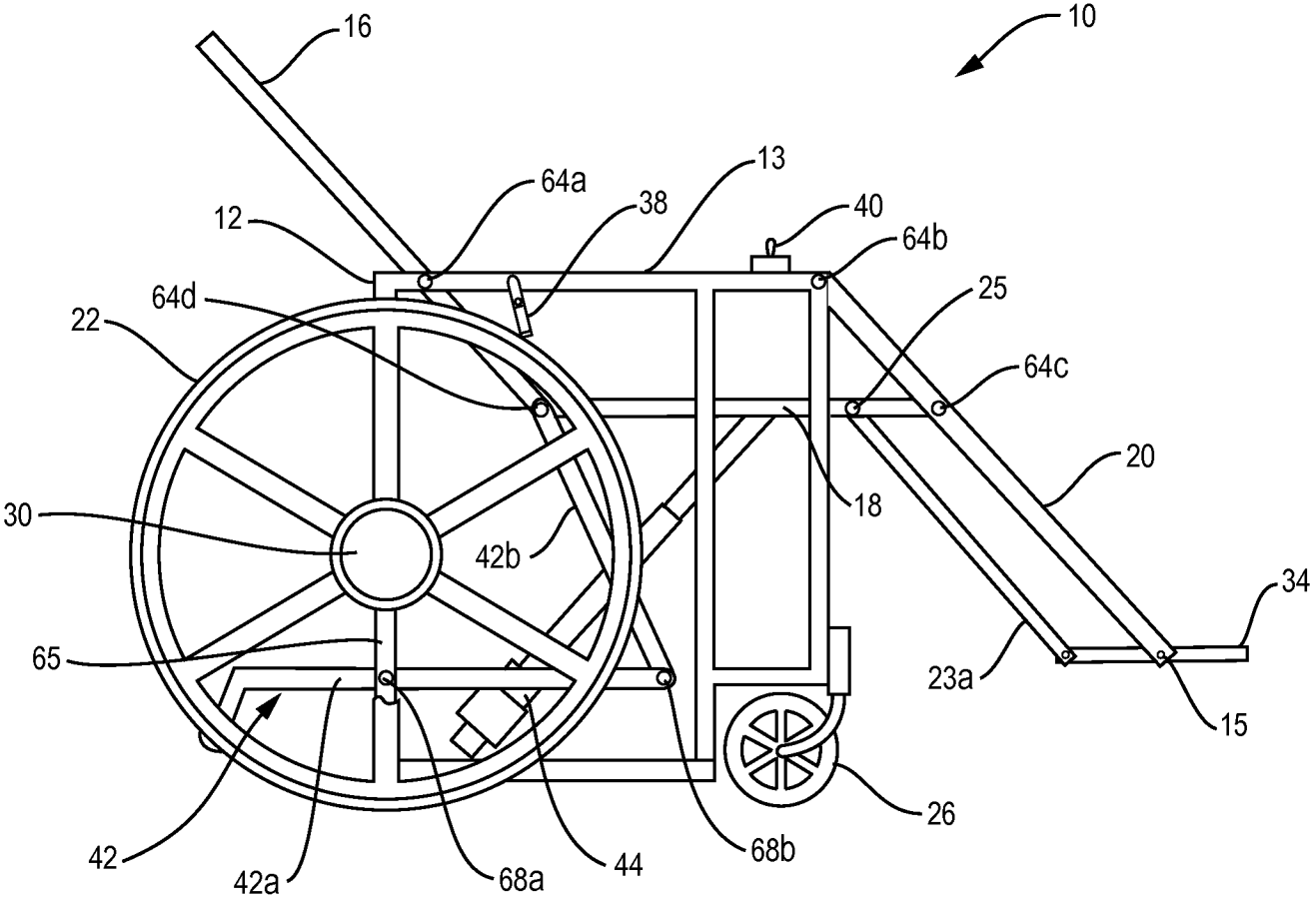
FIG. 4 is a side elevational view of the convertible wheelchair in a transition position.
Figure 5:
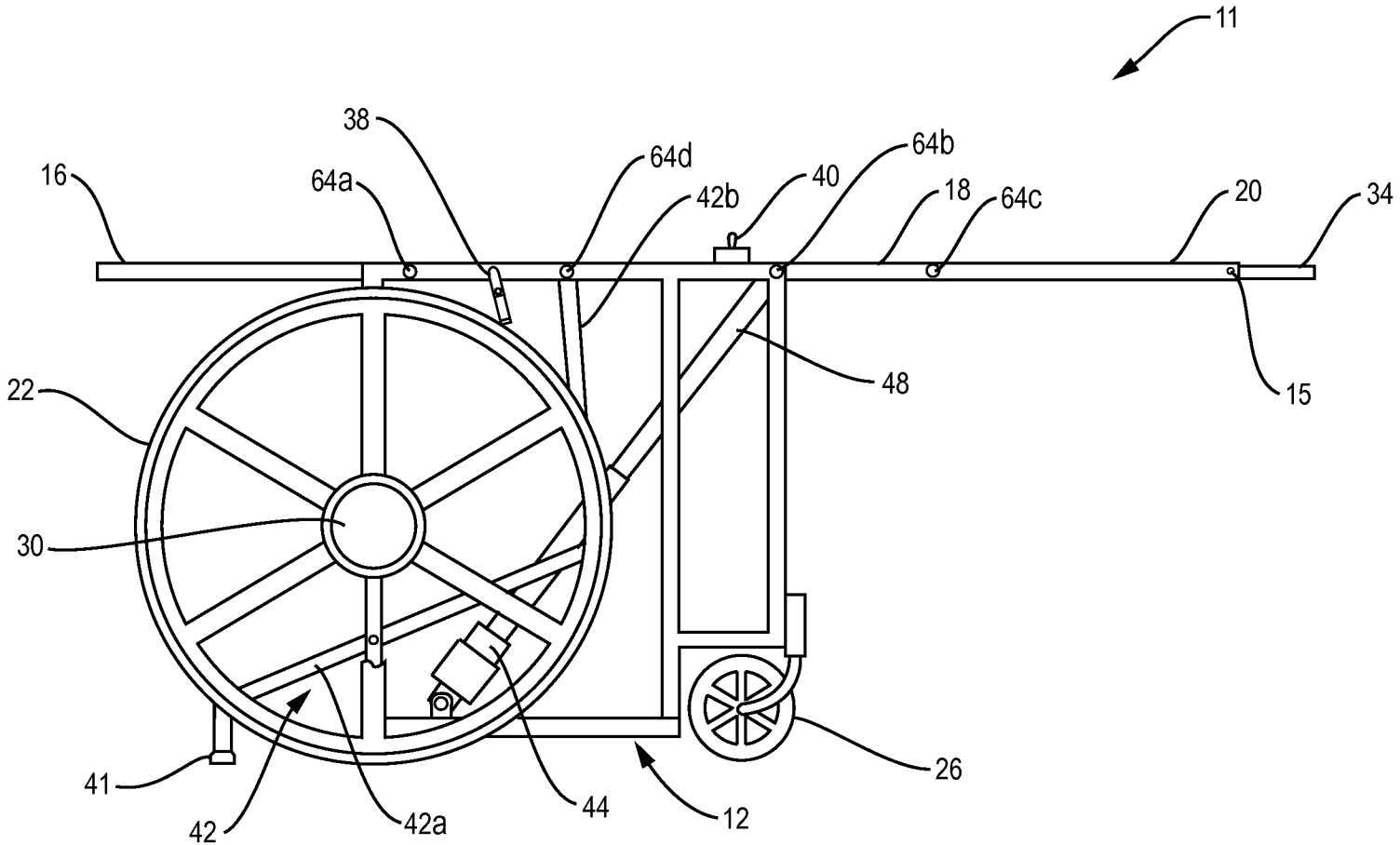
FIG. 5 is a side elevational view of the convertible wheelchair in a reclined position.
Figure 6:
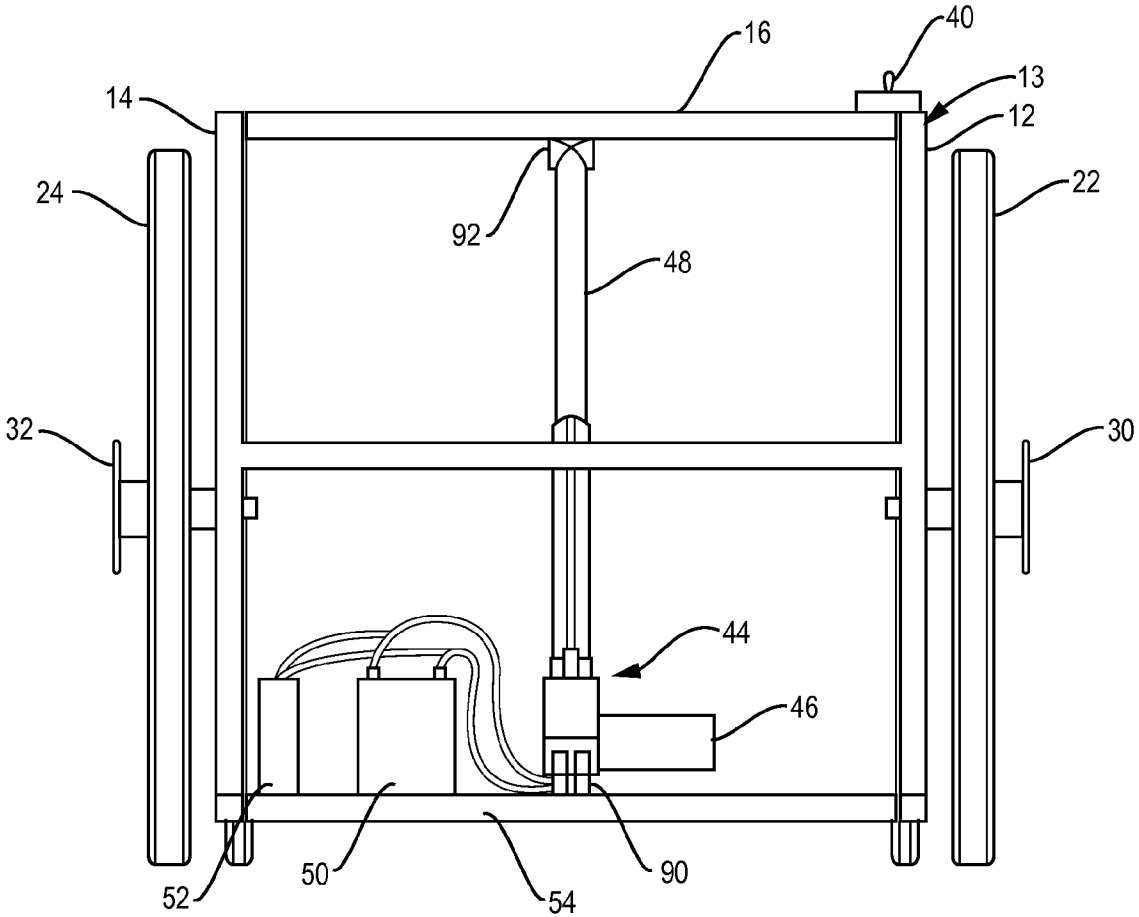
FIG. 6 is a rear view of the convertible wheelchair in a reclined position showing an actuator assembly, a power source, and electric controls enclosure.
Figure 7:
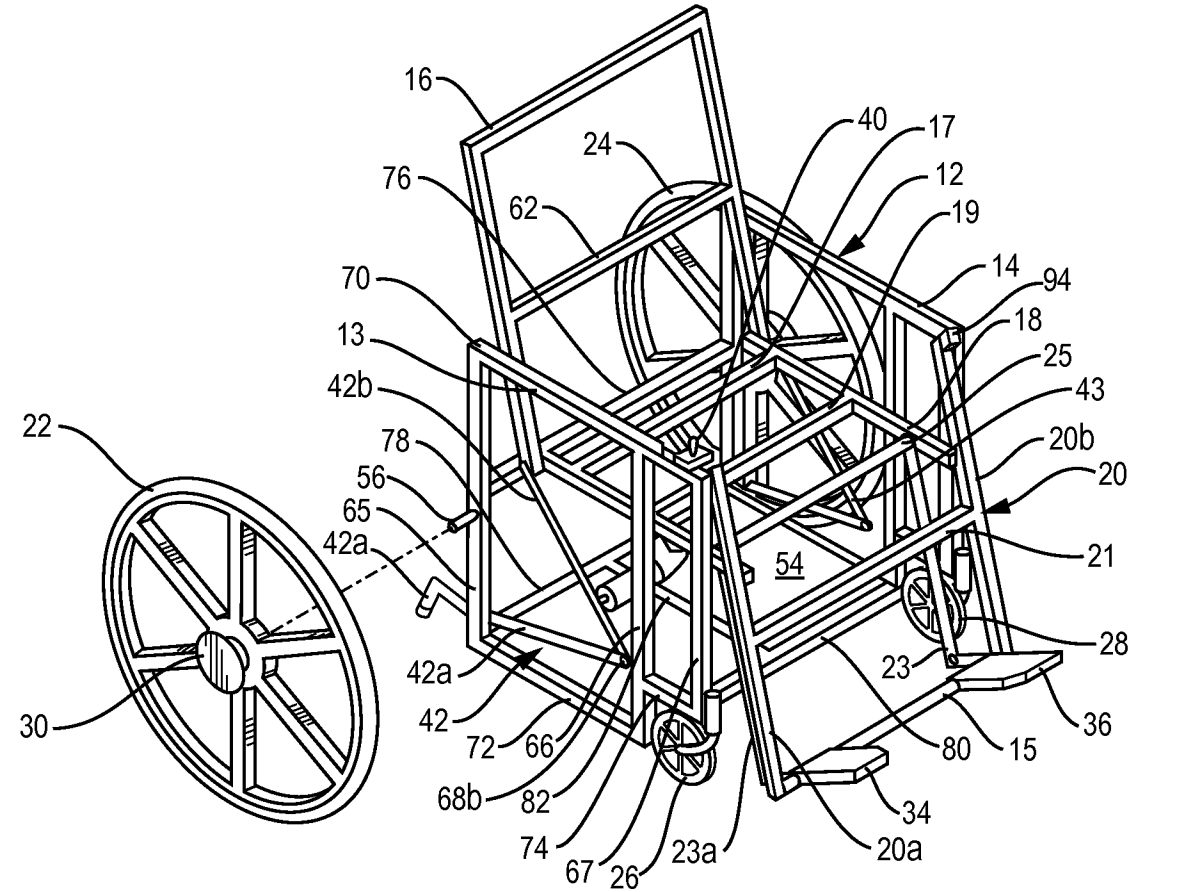
FIG. 7 is a partially exploded perspective view of the convertible wheelchair showing the basic frame, seat, backrest, and leg rest.

Referring now to FIGS. 3-5 and FIG. 7, the upholstered areas of the wheelchair 10 are not shown in these figures in order to better illustrate and describe the frame structure and components of the wheelchair 10. FIG. 3 is a side elevational view of the convertible wheelchair 10 in a chair position and shows a primary four-bar linkage comprised of arm rest support 70 (FIG. 8), seat 18, backrest 16 and leg rest 20. Also shown in FIG. 3 is a secondary four-bar linkage which includes seat 18, leg rest 20, footrest 34 and footrest link 23*a*. FIG. 4 is a side elevational view of the convertible wheelchair 10 in a transition position, and FIG. 5 is a side elevational view of the convertible wheelchair in a reclined position 11. FIG. 7 shows a partially exploded perspective view of the convertible wheelchair. The convertible wheelchair 10 comprises the rigid frame 12 as shown in FIG. 7 having a right side 13 and a left side 14 both of which are identical. The right side comprises three spaced apart vertical legs 65, 66, 67. Vertical legs 65 and 66 extend between a top horizontal bar (or right arm rest support) 70 and a bottom horizontal bar 72. The top horizontal bar on the frame left side 14 is referred to as left arm rest support 71. Vertical leg 67 is not as long as vertical leg 65 and 66, so a short horizontal bar 74 extends between the bottom of leg 67 and the side of leg 66. A right caster 26 is located in the space under short horizontal bar 74, and caster 26 attaches by welding or other commonly known technique to the side of vertical leg 67. Frame 12 with the step from bars 72 to 74 to 67 is designed to have the base of the rigid frame 12 close to the floor. The height of the caster 26 determines the length of leg 67. The left side 14 of rigid frame 12 has the same structural arrangement as the right side 13. An upper horizontal crossbar 76 attaches between the right side 13 and the left side 14 of the frame 12 as shown in FIG. 7. On the bottom of the frame 12 there is a lower rear horizontal crossbar 78 which extends between the rear lower corners of the right side 13 and the left side 14 of the frame 12, and a front horizontal crossbar 80 extends between the front lower corner of the frame right side 13 and the frame left side 14 of the frame 12 parallel to the lower rear horizontal crossbar 78. A front to rear bar 82 extends between approximately the centers of the front horizontal crossbar 80 and the lower rear horizontal crossbar 78. A left caster 28 attaches to the frame left side 14 similar to caster 26 located on the frame right side 13. The lower area of frame 12 forms a shelf 54 for mounting a power source 50 and electric control circuit 52 as shown in FIG. 6. The frame 12 in the preferred embodiment may be constructed with round or rectangular bars whose composition is chosen for light weight, strength and rigidity. The frame 12 made of steel provides extra strength for supporting larger patients. The bars may be welded together to form the various elements of the wheelchair 10 structure such as frame 12.

Figure 8:
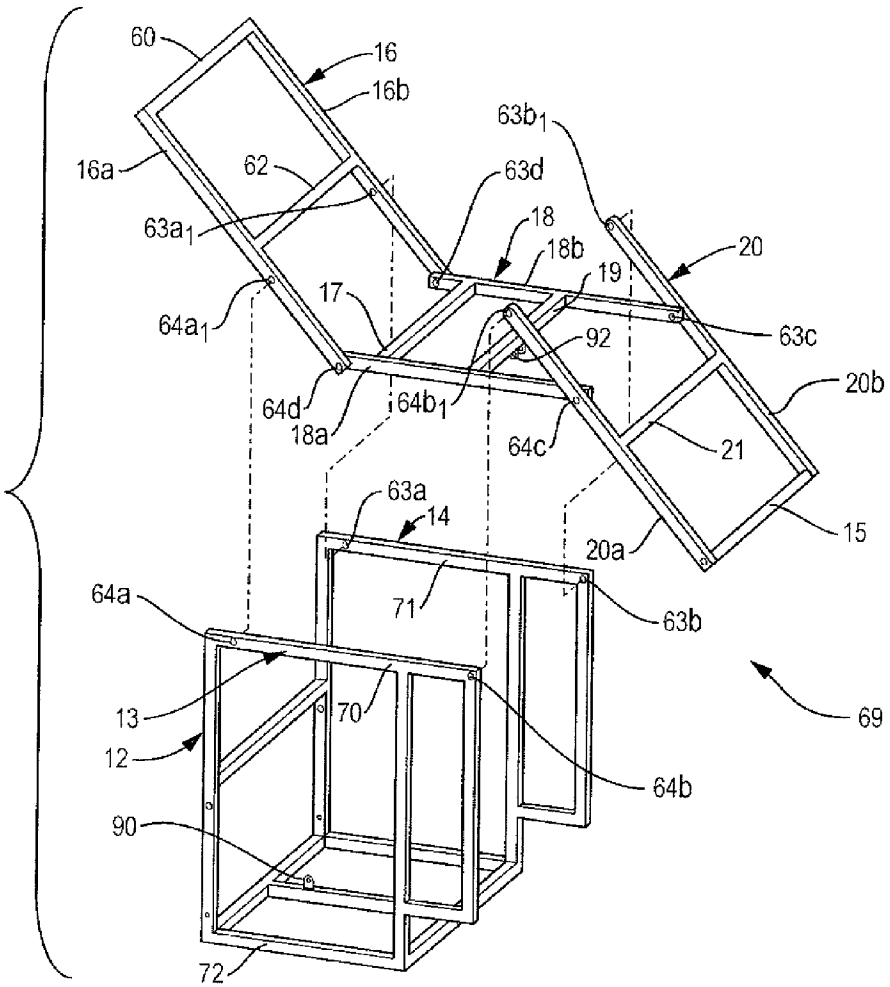
FIG. 8 is an exploded perspective view of a four bar linkage portion of the convertible wheelchair.

Referring to FIG. 4, FIG. 7 and FIG. 8, FIG. 8 is an exploded perspective view of a pair of the primary four-bar linkages 69 portion of the convertible wheelchair 10 which is moved by a linear actuator 44 (FIG. 4). The convertible wheelchair 10 comprises the rigid frame 12, the seat frame 18 with the backrest frame 16 attached by bearings 63*d* and 64*d* to rear corners of the seat frame 18, and the leg rest frame 20 is attached by bearings 63*c* and 64*c* to front corners of the seat frame 18 thereby forming two sets or pairs of the primary four-bar linkages 69. Right arm rest support 70 and left arm rest support 71 of the four-bar linkages 69 as shown in FIG. 8, are part of the rigid frame 12, with the result that as reorientation occurs, the other three frames 16, 18, 20 move while arm rest supports 70 and 71 are stationary. The linear actuator 44 is located between a shelf 54 on the non-moveable frame 12 and a seat center crossbar 19 of the seat frame 18. As the linear actuator 44 extends the arm 48, the seat frame 18 is pushed upward and forward causing the backrest frame 16 to fold backward and the leg rest to rise upward. In the reclined position (gurney), when the arm 48 of the linear actuator 44 is fully extended, the backrest frame 16, seat frame 18 and leg rest frame 20 lie in a horizontal plane which is also the same plane as the left arm rest support 70 and the right arm rest support 71 of the nonmoveable frame 12. There are ten different bearings interconnecting the four-bar linkages 69; four bearings 64*a*, 64*b*, 64*c*, and 64*d* are on the four-bar linkage right side, four bearings 63*a*, 83*b*, 63*c*, and 63*d* are on the four-bar linkage left side, and two bearings 68*a*, 68*b* (FIG. 3) are on the anti-tilt arm 42 side. The backrest frame 16 comprises two spaced apart cross-segments including top crossbar 60 and intermediate crossbar 62 which extend between backrest right side bar 16*a* and backrest left side bar 16*b*, and the backrest 16 is a rigid structure. The seat frame 18 comprises two spaced apart cross-segments 17, 19 between the side segments 18*a*, 18*b*, and the seat frame 18 is a rigid structure. The upper ends of the leg rest frame 20 using bearings $63b_1$, $64b_1$ connect to front corners of the right side 13 of frame 12 and the left side 14 of frame 12. The front corners of the seat frame 18 are attached by bearings 63*c*, 64*c* to the leg rest frame 20 approximately one-third of the way down from the top of the leg rest frame 20. The leg rest frame 20 is three-sided 20*a*, 20*b*, 15 (FIGS. 7 and 8) having a horizontal crossbar 21 extending approximately midway between vertical segments 20*a* and 20*b* from one side to the other side for support purposes, and the leg rest frame 20 is a rigid structure.

Figure 9A:
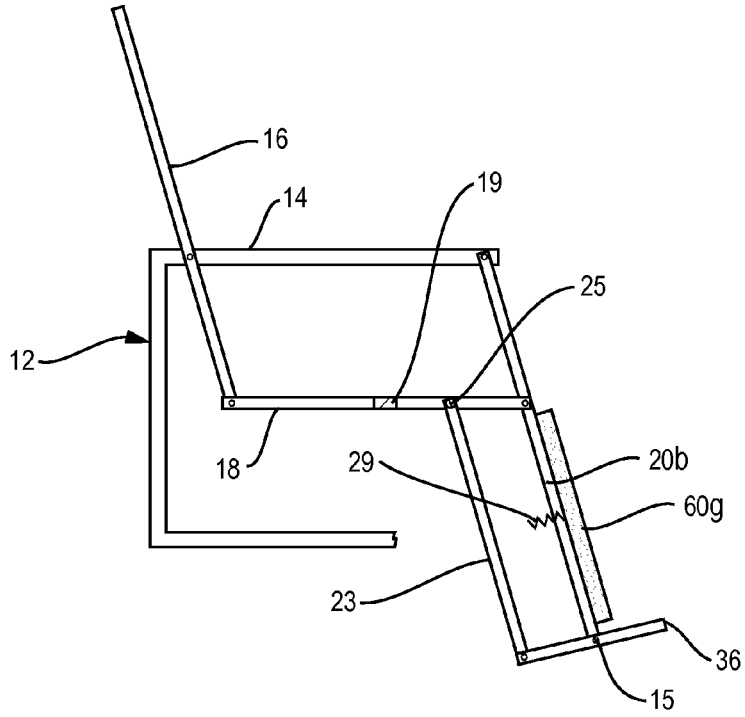
FIG. 9A is a side elevational section view of a footrest mechanism of the wheelchair which includes a pair of two bar linkages pivoting about two round bars when the wheelchair converts to a reclined position.
Figure 9B:
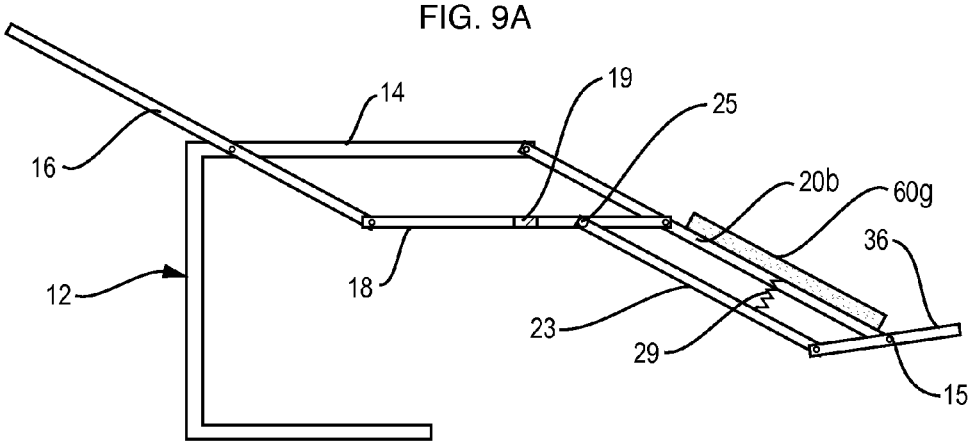
FIG. 9B is a side elevational section view of the footrest mechanism of FIG. 9A when the wheelchair is in a transition position.
Figure 9C:
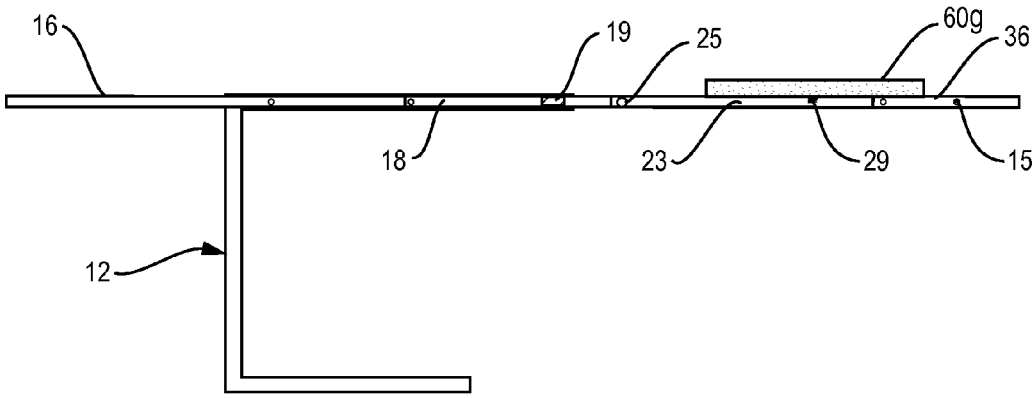
FIG. 9C is a side elevational section view of the footrest mechanism of FIG. 9A when the wheelchair is in a reclined position.

Referring to FIG. 9A and FIG. 9B, FIG. 9A shows a side elevational section view of the left side of a footrest mechanism of the wheelchair 10 for operating the foot rest 20 which includes secondary four-bar linkages. The secondary four-bar linkage on the left side as shown in FIG. 9*a* comprises the seat sidebar 18*b*, leg rest 20*b*, foot rest 36 and left foot rest link 23 between the seat sidebar 18 and foot rest 36. As the linear actuator 44 extends and the leg rest 20*b* rises, the foot rest 36 moves to a horizontal position. A right side of the footrest mechanism comprises another secondary four-bar linkage which includes a corresponding right side linkages-23*a*, foot rest 34 (FIG. 7) connected by a bearing in cooperation with portions of linkage segments 18 and 20*a*. The left side linkages 23, 36 and the right side linkages 23*a*, 34 are positioned at each end respectively of round bars 25, 15 and the linkages pivot about the two round bars 25, 15 when the wheelchair converts to a reclined position as shown in FIG. 9C. FIG. 9B shows a side elevational section view of the left side of the footrest mechanism of FIG. 9A when the wheelchair 10 is in a transition position. The footrest mechanism comprises the link 23 extending from the end of the round bar 25, which is part of the seat 18, to a rear end of the link formed by footrest 36. The round leg rest bar 15 extends through a rear section of the footrests 34, 36 as shown in FIG. 7, and it is attached to the leg rest support frame 20 between leg rest support frame segments 20*a* and 20*b*.

Referring now to FIG. 9C, a side elevational section view of the footrest 36 is shown when the wheelchair is in the reclined position, resulting in both the footrest 36 (left side) and footrest 34 (right side)(FIG. 5) being horizontal or in the same horizontal plane of the wheelchair reclined position 11. Therefore, the primary and the secondary four-bar linkages lie in the same horizontal plane. A compression spring 29 is mounted between the pivot point at the intersection of footrest link 23 and the rear end of footrest 36 and the back of the leg rest pad 60*c* to create a force that will push this pivot point downward when the gurney or reclined position 11 of the wheelchair transitions to the upright chair position, which avoids creating a jamb. The spring 29 is not needed when the gurney has a person on it, but will be needed if the gurney is returned to the upright chair position without a person on it.

Figure 10A:
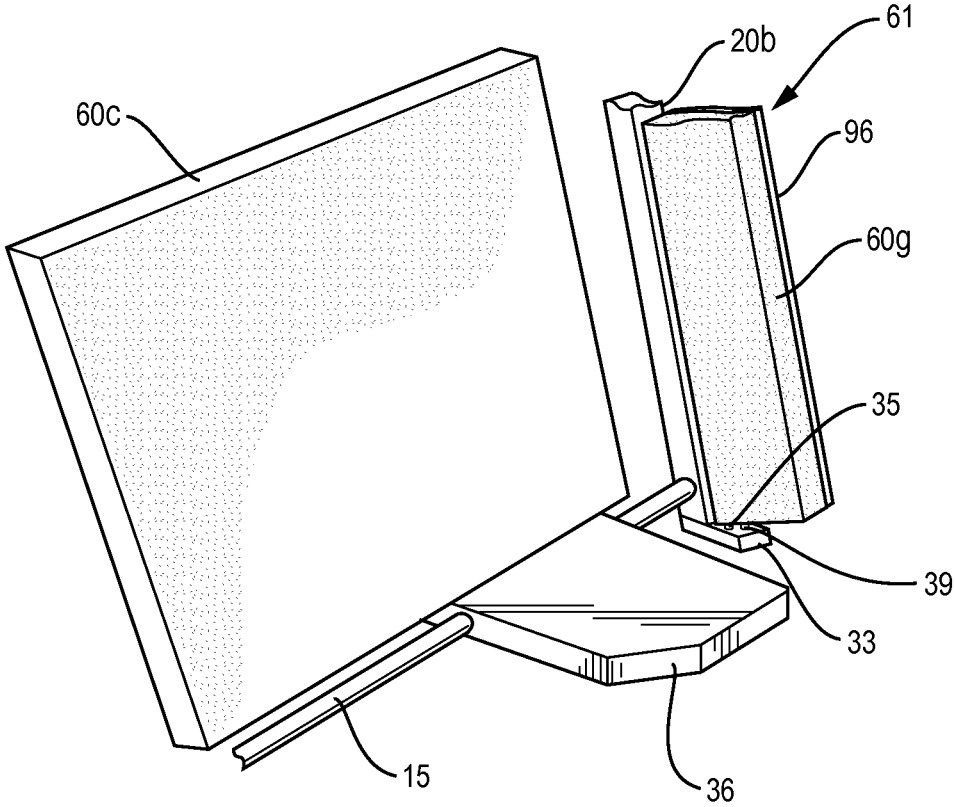
FIG. 10A is a perspective view of a portion of the footrest and a lower portion of a leg rest extension.
Figure 10B:
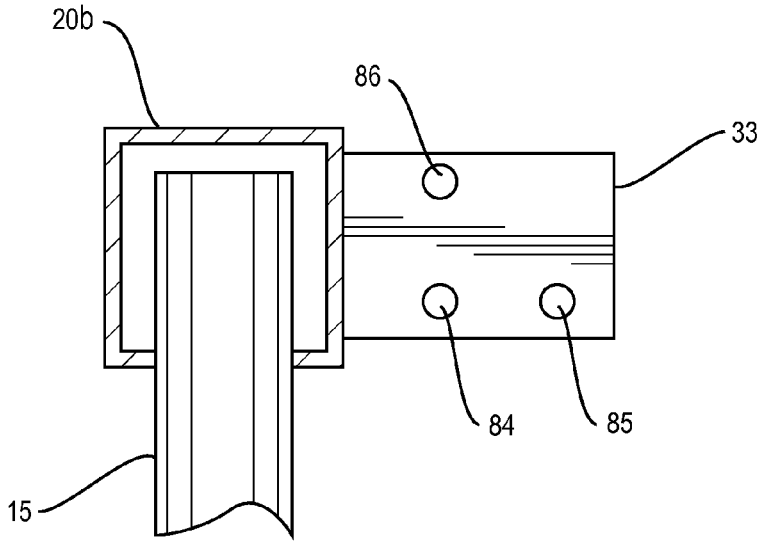
FIG. 10B is a plan view of a base plate having pin holes for receiving a lock pin on the bottom of the leg rest extension.
Figure 10C:
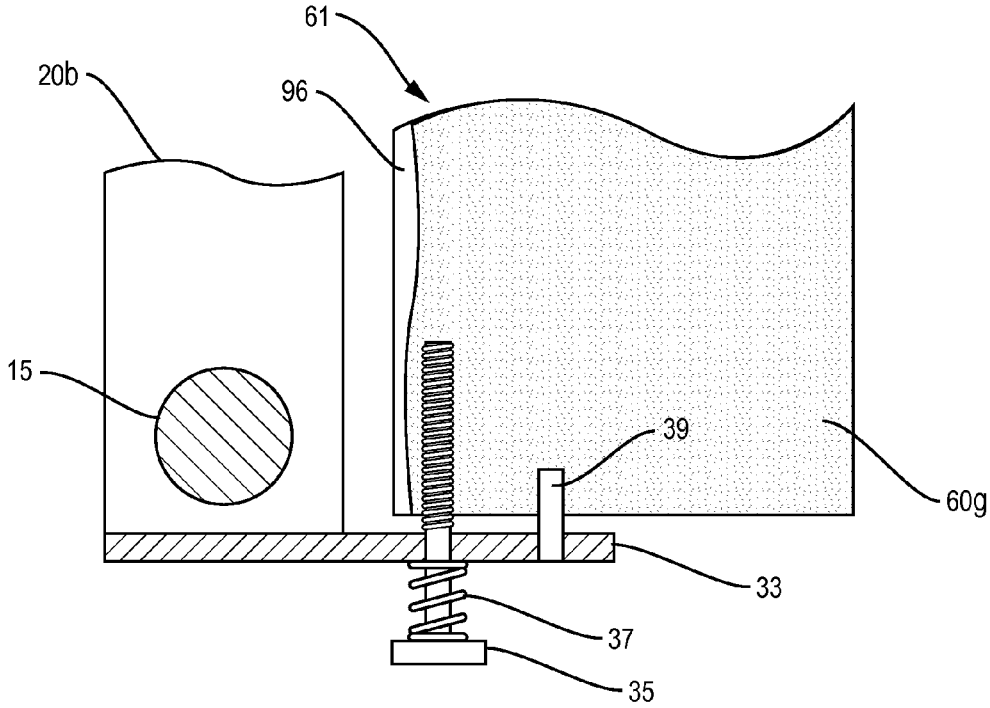
FIG. 10C is an enlarged side elevational view of the lower portion of the leg rest extension and the base plate for securing it in one of two positions.

Referring now to FIGS. 1, 10A, 10B and 10C, FIG. 1 shows a leg rest extension 61 positioned to the left of the leg rest pad 60C, and when lifted upward by approximately one-quarter to three-eights of an inch, it may be rotated outward approximately ninety degrees. This rotation of the leg rest extension 61, as shown in FIG. 2, allows it to lay flat when the wheelchair is in the reclined or gurney position and forms a bridge to fill in the space that would otherwise exist between leg rest pad 60*c* of the gurney surface and an adjacent patient transfer area such as a bed. FIG. 10A is a perspective view of the footrest 36 under the leg rest pad 60*c* and the lower portion of the leg rest extension 61 adjacent to the leg rest pad 60*c* and the footrest 36. FIG. 10B is a plan view of a base plate 33 located under the leg rest extension 61, and the base plate 33 is attached such as by welding to the bottom of a segment 20*b* of the leg rest support frame 20. The base plate 33 includes a threaded hole 84 for insertion of a threaded bolt 35 and pin holes 85, 86 which are for receiving the lock pin 39 protruding from the bottom of the leg rest extension 61 (FIG. 10C). A top plate 94 (FIG. 1) is attached such as by welding or other commonly known means to the top front side of leg rest support frame segment 20*b*, and the top plate 94 comprises a hole in the bottom portion of plate 94 of sufficient diameter to receive pin 95 which protrudes from the top of a leg rest extension support panel 96 of the leg rest extension 61.

FIG. 10C shows an enlarged side elevation view of the lower portion of the leg rest extension 61, located adjacent to the leg rest support frame segment 20*b*, and the base plate 33 is attached to the bottom of leg rest support frame segment 20*b*. The bolt 35 is a threaded machine bolt, and it screws into the bottom of the leg rest extension support panel 96. The lock pin 39 extends from the bottom of leg rest extension support panel 96 and fits into base plate holes 85 or 86. The bolt 35 has coiled spring 37 positioned under its head when it is inserted into hole 84 in the base plate 33. When any portion of the leg rest extension 61 is pulled upward, the coiled spring 35 compresses and the locking pin 39 comes out of its hold 85 so that the leg rest extension 61 can be rotated approximately ninety degrees and then the locking pin 39 is pushed into hole 86 in the base plate 33 by the coiled spring 35. Also, FIG. 10C shows the round bottom leg rest bar 15 attached to left leg rest support frame segment 20*b*.

Referring again to FIGS. 3-5, an anti-tip mechanism 42 is shown comprising two links 42*a* and 42*b*. Link 42*a* is connected by a bearing 68*a* to a lower point on the inside of first vertical leg 65 located on the right side of frame 12. The other end of link 42*b* is connected to the right lower corner bar end of backrest 16 by another bearing 64*d*. Also, the right rear corner of the seat 18 is connected to the right lower corner of the back rest 16 by bearing 64*d*. Links 42*a* and 42*b* rotate about these bearing points 68*a*, 68*b*, 64*d* as the wheelchair 10 transitions to the reclined position 11 at which point the lower end of link 42*a* contacts a surface or floor on which the wheelchair 10 rests. A protrusion 41 on the lower end of link 42*a* comprises a non-slip material including rubber. The main frame 12 including the four-bar linkage 69 and the anti-tip mechanism 42 may be constructed of aluminum or steel.

Referring again to FIG. 7, the partially exploded perspective view of the convertible wheelchair 10 shows a pair of laterally spaced large diameter rear wheels 22, 24 each mounted on a stub axial 56 extending from the right side 13 and another similar stub axial (not shown) on the left side 14 of the frame 12. Attached to the hub of each of the rear wheels 22, 24 is a docking disc 30, 32. The docking disc slides into a horizontal U-shaped plate (not shown) which provides a docking slot attached to a bed frame by bolts or screws. When the wheelchair is correctly docked to the bed via the docking slot, a sensor on the bed will activate a light or a buzzer known to one skilled in the art. This provides a signal for the user to engage a brake 38 and indicates that it is now safe to activate the switch 40 to move the wheelchair to the reclined or gurney position 11.

Each of the rear wheels 22, 24 supports a hand drive wheel for easy manually propelling and maneuvering of the chair 10 by the patient when sitting in the wheelchair 10. The wheels with hand drive can be purchased as a unit, or a bicycle type wheel may be purchased without hand drive. Because this chair is designed to be housebound, the tire will stay clean and can be used for hand drive propulsion. The rear wheels 22, 24 include bearings. An axle bolt commonly known in the art passes through the bearings in the center of the wheels 22, 24 and through a hole in the frame 12. Spacing washers are placed on the axle bolt followed by a lock nut which is tightened to receive the wheel onto the frame 12. The wheels are not rapid disconnect and not capable of removal without tools for safety when docking against a bed. A standard wheelchair brake 38 (FIG. 1) known to one skilled in the art is attached to the frame 12 on each side of the wheelchair 10 to provide standard friction braking against the rubber wheels 22, 24.

Referring to FIGS. 3-6, FIG. 6 is a rear view of the convertible wheelchair 10 in a reclined position with certain components such as the anti-tip arms 42, 43 removed for clear viewing of the other components. An electric linear actuator 44 (electric piston) is shown having a lower portion including a motor 46 mounted to a rear portion of the shelf 54 area of frame 12, and extending out of the linear actuator 44 is an actuator arm 48 which attaches to the seat center crossbar 19. The angle of attachment of the linear actuator is approximately fifty degrees, and it is selected for mechanical advantage; the base of the actuator 44 attaches to a bracket 90 located on frame member 82 in FIG. 7 and the actuator arm 48 attaches to a bracket 92 under the center of seat frame 19. When the linear actuator 44 is activated by a switch 40 (FIG. 3) mounted on the opposite side of frame 12 to the docking side of the chair, the actuator arm 48 extends out of the electric actuator 44 and operates the four-bar linkage 69 secured to the frame 12 with bearings 63*b* and 64*b*. The actuator arm 48 pushes the seat 18 upward from underneath the seat 18 and the four-bar linkage arrangement between the seat 18, the back rest 16 and the leg rest 20 causes the leg rest 20 to rotate upward and the back rest 16 to rotate downward until the entire four-bar linkage 69 is in a flat horizontal state as shown in FIG. 5. FIG. 6 shows the power source 50 storage battery which provides a DC operating voltage to the linear actuator 44 and to the actuator control circuit 52. The power source 50 may be embodied by a 12 volt, 11 amp-hour rechargeable battery commonly available. The linear actuator 44 may be embodied by a unit having 400 lb. load capacity and 12 inch stroke, manufactured by Firgelli Automations of Bellingham, Wash. 98227. The bearings 64 may be embodied by Part No. 5155K387, manufactured by McMaster-Carr, of Elmhurst, Ill.

Figure 11:
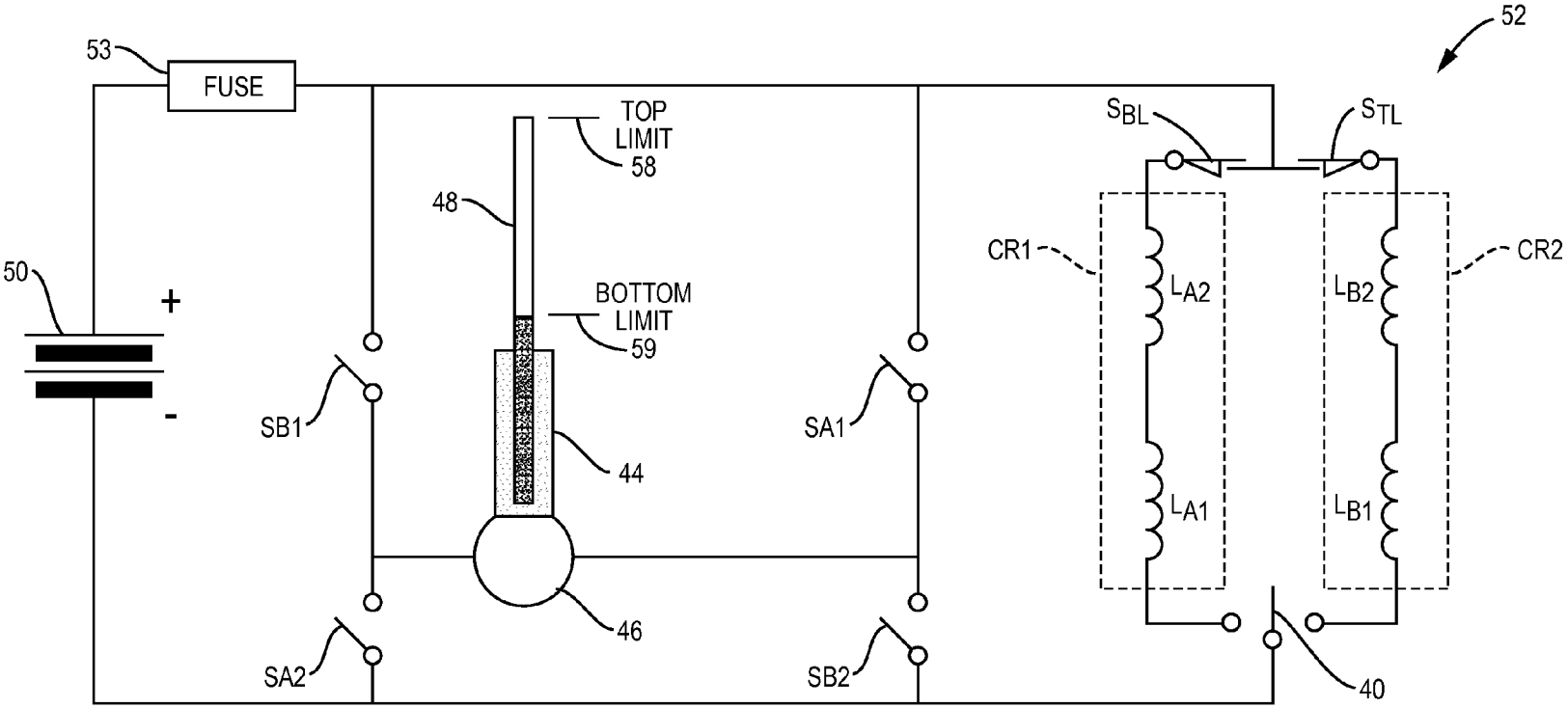
FIG. 11 is a schematic diagram of a control circuit for operating the convertible wheelchair.

Referring to FIG. 11, a schematic diagram of one embodiment of the control circuit 52 is shown for operating the convertible wheelchair 10. The control circuit 52 comprises a single pole double throw switch 40, two control relays CR1 and CR2, and two limit switches $S_{BL}$ and $S_{TL}$. The battery or power source 50 provides 12 volts to the circuit 52 through a fuse 53. Control relay CR1 comprises two coils LA1 and LA2 which activate relay switches SA1 and SA2 respectively. Control relay CR2 comprises two coils LB1 and LB2 which activate relay switches SB1 and SB2 respectively. The limit switches $S_{BL}$ and $S_{TL}$ are activated by the position of the actuator arm 48. The control switch 40 has an OFF normal position in a center position of the switch 40 and when the user pushes the switch left or right, the wheelchair moves up to the reclined (gurney) position 11 or down to the chair position 10. The top limit switch $S_{TL}$ activates when the actuator arm 48 moves the chair 10 to the reclined position 11 causing control relay CR2 to deactivate and open relay switches SB1 and SB2 which remove the 12 volts form the actuator motor 46. The linear actuator 44 is a DC motor 46 that drives a lead screw, and when there is no electrical power to the motor, the lead screw cannot move and, therefore, cannot be driven by an external mechanical force which is an important safety feature of the convertible wheelchair 10. When the control switch 40 is moved in the direction to move the chair 10 from the reclined position 11 to the chair position, the actuator arm 48 retracts and activates the bottom limit switch $S_{BL}$ which causes the control relay CR1 to deactivate which results in relay switches SA1 and SA2 opening and removing the 12 volts from the actuator motor 46.

The control relays CR1 and CR2 may be embodied by Part No. 275-226 available from Radio Shack stores. The limit switches $S_{BL}$ and $S_{TL}$ may be embodied by Part No. 275-016 available from Radio Shack stores.

This invention has been disclosed in terms of a preferred embodiment. It will be apparent that many modifications can be made to the disclosed apparatus and method without departing from the invention. Therefore, it is the intent of the appended claims to cover all such variations and modifications as come within the true spirit and scope of this invention.

What is claimed is:

1. A convertible wheelchair comprising:

means for forming a chair within a frame, said chair comprises components pivotally interconnected;

means attached between a bottom portion of said frame and a seat portion of said chair for converting said wheelchair by a user from a chair position to a reclined position or from a reclined position to said chair position; and means attached to a right side and a left side of said frame for supporting said chair forming means, said supporting means including means for enabling said wheelchair to be propelled by said user when sitting in said chair.

2. The convertible wheelchair as recited in claim 1 wherein said chair forming means comprises a backrest pivotally attached to said seat portion of said chair and a leg rest pivotally attached to said seat portion.

3. The convertible wheelchair as recited in claim 1 wherein said converting means comprises means for controlling converting said wheelchair from said chair position to said reclined position or from said reclined position to said chair position in response to a signal generated by a user's action.

4. The convertible wheelchair as recited in claim 1 wherein said supporting means comprises a pair of rear wheels and a pair of front wheels attached to said frame, said pair of rear wheels being greater in diameter than said pair of front wheels to enable said user to grasp said rear wheels.

5. The convertible wheelchair as recited in claim 2 wherein said backrest being pivotally attached at a first point to a first end of said frame and at a second point of said backrest to a first end of said seat, and said leg rest being pivotally attached at a first point to a second end of said frame and at a second point of said leg rest to a second end of said seat forming a primary pair of four-bar linkages.

6. A convertible wheelchair comprising:

a frame supported by front wheels and rear wheels, said rear wheels enabling a user to manually propel said wheelchair when sitting in said wheelchair;

a backrest pivotally mounted at intermediate points between first and second sides of said frame;

a seat having front ends and rear ends, said seat being connected pivotally at said rear ends to lower ends of said backrest;

a leg rest having upper ends pivotally connected to front corners of said frame and intermediate points on said leg rest connected to said front ends of said seat;

an actuator having a lower end mounted to a bottom panel of said frame and an arm of said actuator being attached at a predetermined acute angle measured with respect to said bottom panel and to approximately a midsection of said seat; and controls including a switch for a user to activate said actuator which converts said wheelchair from a chair position to a reclined position or from a reclined position to a chair position.

7. The convertible wheelchair as recited in claim 6 wherein said leg rest comprises a pair of footrests, said footrests pivoting to a horizontal position when said wheelchair converts from said chair position to said reclined position.

8. The convertible wheelchair as recited in claim 6 wherein said wheelchair comprises said bottom panel, positioned between said frame, for supporting a power source, electric controls and said actuator.

9. The convertible wheelchair as recited in claim 6 wherein said wheelchair comprises means positioned adjacent to each of said rear wheels for stopping said wheelchair from moving.

10. The convertible wheelchair as recited in claim 6 wherein said wheelchair comprises a leg rest extension adjacent to said leg rest for closing space between said wheelchair and a transfer area when said wheelchair is in said reclined position.

11. The convertible wheelchair as recited in claim 6 wherein said wheelchair comprises means for preventing said wheelchair from turning over said backrest reclines when said wheelchair converts from said chair position to said reclined position.

12. The convertible wheelchair as recited in claim 11 wherein said means for preventing said wheelchair from turning over due to shifting of said user's weight in said chair or shifting of said user's weight along said reclined wheelchair comprises an anti-tip arm having at least two interconnected links.

13. The convertible wheelchair as recited in claim 6 wherein:

said controls activated by said user comprise a pair of limit switches;

a first switch of said pair of limit switches being activated by said arm of said actuator when said user converts said wheelchair from said chair position to said reclined position and said actuator arm becomes fully extended; and a second switch of said pair of limit switches being activated when said user converts said wheelchair from said reclined position to said chair position and said actuator arm becomes fully retracted.

14. The convertible wheelchair as recited in claim 6 wherein each point of connection between said frame, backrest, seat and leg rest comprises a bearing.

15. The convertible wheelchair as recited in claim 14 wherein said connection between said frame, said backrest, said seat and said leg rest comprises a first pair of four-bar linkages.

16. The convertible wheelchair as recited in claim 15 wherein said leg rest comprises a footrest mechanism having a second pair of four-bar linkages whereby when said actuator is activated, said actuator arm pushes said seat upward from underneath said seat, and said first pair of four-bar linkages and said second pair of four-bar linkages connected between said backrest, said seat, said leg rest and said footrest cause said leg rest to rotate upward and said backrest to rotate downward, until both of said four-bar linkages are in a horizontal plane forming said reclined position.

17. The convertible wheelchair as recited in claim 6 wherein each of said rear wheels comprises a docking disc in the center of said rear wheels.

18. The convertible wheelchair as recited in claim 6 wherein each of said front wheels comprises a caster.

* * * * *